US011802696B2

(12) United States Patent
Yamauchi et al.

(10) Patent No.: US 11,802,696 B2
(45) Date of Patent: Oct. 31, 2023

(54) OUTDOOR UNIT FOR AIR-CONDITIONING APPARATUS AND AIR-CONDITIONING APPARATUS

(71) Applicant: MITSUBISHI ELECTRIC CORPORATION, Tokyo (JP)

(72) Inventors: Hidetaka Yamauchi, Tokyo (JP); Kentaro Yonehara, Tokyo (JP); Hiroyuki Jinnai, Tokyo (JP); Toshiyuki Kubono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 146 days.

(21) Appl. No.: 17/606,916

(22) PCT Filed: Aug. 1, 2019

(86) PCT No.: PCT/JP2019/030185
§ 371 (c)(1),
(2) Date: Oct. 27, 2021

(87) PCT Pub. No.: WO2021/019758
PCT Pub. Date: Feb. 4, 2021

(65) Prior Publication Data

US 2022/0205653 A1 Jun. 30, 2022

(51) Int. Cl.
*F24F 1/36* (2011.01)
*F24F 1/46* (2011.01)

(52) U.S. Cl.
CPC . *F24F 1/36* (2013.01); *F24F 1/46* (2013.01)

(58) Field of Classification Search
CPC ..... F25B 2400/0409; F24F 1/14; F24F 1/22; F24F 1/36; F24F 1/46; F24F 1/34
See application file for complete search history.

(56) References Cited

U.S. PATENT DOCUMENTS 4,413,683 A * 11/1983 Hune ..... A62C 3/00 220/88.1
2014/0216094 A1 8/2014 Hoshika et al.
2018/0328635 A1 11/2018 Tashiro et al.

FOREIGN PATENT DOCUMENTS

CN 202254016 U 5/2012
CN 204900999 U * 12/2015
(Continued)

OTHER PUBLICATIONS

International Search Report of the International Searching Authority dated Sep. 10, 2019 for the corresponding International application No. PCT/JP2019/030185 (and English translation).
(Continued)

*Primary Examiner* — Schyler S Sanks
(74) *Attorney, Agent, or Firm* — POSZ LAW GROUP, PLC

(57) ABSTRACT

An outdoor unit for an air-conditioning apparatus includes a housing; a compressor provided in the housing and configured to compress refrigerant; an outdoor heat exchanger provided in the housing and allowing refrigerant and air to exchange heat with each other; a partition plate provided in the housing and partitioning an inside of the housing into a fan chamber and a machine chamber in which the compressor is provided; an electronic component provided in the machine chamber; a refrigerant pipe provided in the machine chamber and connecting the compressor and the outdoor heat exchanger and disposed above the electronic component; a valve connected to the refrigerant pipe in the machine chamber and disposed above the electronic component; and a drip inhibiting portion that covers the refrigerant pipe and a lower part of the valve and inhibits water dripping from the refrigerant pipe from dripping onto the electronic component.

9 Claims, 9 Drawing Sheets

(56) References Cited

FOREIGN PATENT DOCUMENTS

| | | | | |
|---|---|---|---|---|
| CN | 204900999 | U | | 12/2015 |
| EP | 2 481 995 | A1 | | 8/2012 |
| EP | 3 650 765 | A1 | | 5/2020 |
| JP | H02-302537 | A | | 12/1990 |
| JP | H09-062268 | A | | 3/1997 |
| JP | H10-132335 | A | | 5/1998 |
| JP | 2000-148157 | A | | 5/2000 |
| JP | 2001-059664 | A | | 3/2001 |
| JP | 2001059664 | A | * | 3/2001 |
| JP | 2003-074894 | A | | 3/2003 |
| JP | 2009-204238 | A | | 9/2009 |
| JP | 2010-071520 | A | | 4/2010 |
| JP | 2010071520 | A | * | 4/2010 |
| JP | 2013-053792 | A | | 3/2013 |
| JP | 2013-053815 | A | | 3/2013 |
| JP | 2013-096671 | A | | 5/2013 |
| JP | 2014-047977 | A | | 3/2014 |

OTHER PUBLICATIONS

Examination Report dated May 24, 2022 issued in corresponding DE Patent Application No. 112019007594.2 (and English Translation).
Office Action dated Oct. 27, 2022 issued in corresponding SE Patent Application No. 2151402-1.
Office Action dated Nov. 18, 2022 issued in corresponding CN Patent Application No. 201980098415.8 (and English translation).
Office Action dated Aug. 16, 2022 issued in corresponding JP Patent Application No. 2021-536571 (and English translation).

* cited by examiner

OUTDOOR UNIT FOR AIR-CONDITIONING APPARATUS AND AIR-CONDITIONING APPARATUS

CROSS REFERENCE TO RELATED APPLICATION

This application is a U.S. National Stage Application of International Application No. PCT/JP2019/030185, filed on Aug. 1, 2019, the contents of which are incorporated herein by reference.

TECHNICAL FIELD

The present disclosure relates to an outdoor unit, including a valve, for an air-conditioning apparatus and an air-conditioning apparatus.

BACKGROUND ART

Outdoor units, including a valve, for air-conditioning apparatuses have been known as outdoor units for air-conditioning apparatuses. When refrigerant cooled in a cooling operation passes through the inside of a refrigerant pipe connected to a valve or other components, dew may be formed on the refrigerant pipe because of the difference in temperature between the inside and the outside of the refrigerant pipe. Patent Literature 1 discloses an outdoor unit that accommodates a compressor, a four-way solenoid valve, and refrigerant pipes connected to the compressor. In Patent Literature 1, refrigerant pipes in the part of a refrigerant circuit disposed above electronic components such as the four-way solenoid valve are not disposed over the electronic components. This configuration in Patent Literature 1 is intended to prevent, even when dew is formed on a refrigerant pipe and drips down, the dew having dripped from adhering to the electronic components.

CITATION LIST

Patent Literature

Patent Literature 1: Japanese Unexamined Patent Application Publication No. 10-132335

SUMMARY OF INVENTION

Technical Problem

However, in the outdoor unit disclosed in Patent Literature 1, when a refrigerant pipe has to be disposed over the electronic components because of the limited space in the outdoor unit, dew formed on the refrigerant pipe may drip down and adhere to the electronic components.

The present disclosure is made to solve such a problem and provides an outdoor unit for an air-conditioning apparatus and an air-conditioning apparatus that inhibit, even when dew is formed on a refrigerant pipe, the dew from dripping onto electronic components.

Solution to Problem

An outdoor unit for an air-conditioning apparatus according to an embodiment of the present disclosure includes a housing; a compressor provided in the housing, the compressor being configured to compress refrigerant; an outdoor heat exchanger provided in the housing, the outdoor heat exchanger allowing refrigerant and air to exchange heat with each other; a partition plate provided in the housing, the partition plate partitioning an inside of the housing into a fan chamber and a machine chamber in which the compressor is provided; an electronic component provided in the machine chamber; a refrigerant pipe provided in the machine chamber, the refrigerant pipe connecting the compressor and the outdoor heat exchanger and being disposed above the electronic component; a valve connected to the refrigerant pipe in the machine chamber, the valve being disposed above the electronic component; and a drip inhibiting portion that covers the refrigerant pipe and a lower part of the valve, the drip inhibiting portion inhibiting water dripping from the refrigerant pipe from dripping onto the electronic component.

Advantageous Effects of Invention

According to an embodiment of the present disclosure, the drip inhibiting portion covers the lower part of the valve and the refrigerant pipe disposed above the electronic component. Thus, the drip inhibiting portion is capable of inhibiting, even when dew is formed on the refrigerant pipe connected to the valve, the dew from dripping onto the electronic component at a lower position.

DESCRIPTION OF EMBODIMENTS

An outdoor unit for an air-conditioning apparatus and an air-conditioning apparatus in an embodiment of the present disclosure will be described below with reference to the drawings. The present disclosure is not limited by the embodiment described below. The size relationships of the components in the following drawings including FIG. 1 may differ from those of actual ones. In the following descriptions, terms that mean directions are used as appropriate to make the present disclosure easy to understand. However, these terms are used for describing the present disclosure and do not limit the present disclosure. Examples of terms that mean directions include "up", "down", "right", "left", "forward", and "backward".

Embodiment 1

Figure 1:
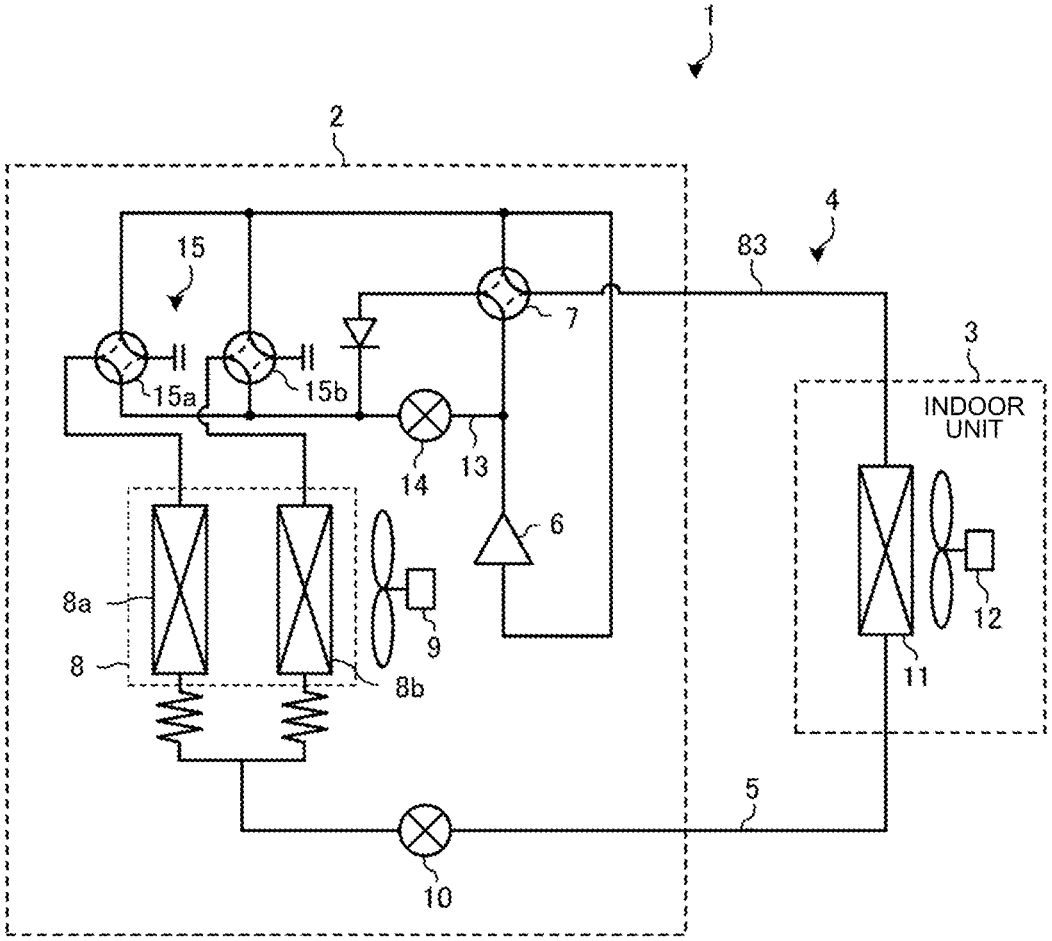
FIG. 1 is a circuit diagram illustrating an air-conditioning apparatus 1 according to Embodiment 1.

FIG. 1 is a circuit diagram illustrating an air-conditioning apparatus 1 according to Embodiment 1. As illustrated in FIG. 1, the air-conditioning apparatus 1 is an apparatus for conditioning air in an indoor space. The air-conditioning apparatus 1 includes an outdoor unit 2 and an indoor unit 3. The outdoor unit 2 includes a compressor 6, a flow switching device 7, outdoor heat exchangers 8, an outdoor fan 9, an expansion unit 10, valves 15, bypass pipes 13, and a bypass flow control device 14. The indoor unit 3 includes an indoor heat exchanger 11 and an indoor fan 12.

The compressor 6, the flow switching device 7, the outdoor heat exchangers 8, the expansion unit 10, and the indoor heat exchanger 11 are connected by refrigerant pipes 5 and form a refrigerant circuit 4. The compressor 6 suctions low-temperature and low-pressure refrigerant, compresses the suctioned refrigerant into high-temperature and high-pressure refrigerant, and discharges the high-temperature and high-pressure refrigerant. The flow switching device 7 switches between directions in which refrigerant flows in the refrigerant circuit 4. The flow switching device 7 is, for example, a four-way valve. For example, the outdoor heat exchangers 8 allow outdoor air and refrigerant to exchange heat with each other. The outdoor heat exchangers 8 are used as condensers in a cooling operation and are used as evaporators in a heating operation.

The outdoor heat exchangers 8 include a first heat exchanger 8*a* and a second heat exchanger 8*b*, whose passages are parallel to each other. The first heat exchanger 8*a* is, for example, an upper one of the outdoor heat exchangers 8. The second heat exchanger 8*b* is, for example, a lower one of the outdoor heat exchangers 8. The outdoor fan 9 is a device configured to send outdoor air to the outdoor heat exchangers 8. The expansion unit 10 is a pressure reducing valve or an expansion valve configured to decompress and expand refrigerant. The expansion unit 10 is, for example, an electronic expansion valve whose opening degree is controlled. The valves 15 switch between a direction in which refrigerant flows toward the first heat exchanger 8*a* and a direction in which refrigerant flows toward the second heat exchanger 8*b*. For example, the valves 15 include a first three-way valve 15*a* and a second three-way valve 15*b*. The first three-way valve 15*a* connects the flow switching device 7, the first heat exchanger 8*a*, and a suction port of the compressor 6. The second three-way valve 15*b* connects the flow switching device 7, the second heat exchanger 8*b*, and the suction port of the compressor 6.

The bypass pipes 13 connect a part between a discharge port of the compressor 6 and the flow switching device 7 and a part between the first three-way valve 15*a* and the second three-way valve 15*b*. High-temperature refrigerant discharged from the compressor 6 flows into the bypass pipes 13. The bypass pipes 13 are provided with the bypass flow control device 14. The bypass flow control device 14 controls the amount of refrigerant flowing in the bypass pipes 13.

For example, the indoor heat exchanger 11 allows indoor air and refrigerant to exchange heat with each other. The indoor heat exchanger 11 is used as an evaporator in the cooling operation and is used as a condenser in the heating operation. The indoor fan 12 is a device configured to send indoor air to the indoor heat exchanger 11.

(Operation Mode: Cooling Operation)

Next, the operation modes of the air-conditioning apparatus 1 will be described. The air-conditioning apparatus 1 in Embodiment 1 has operation modes including the cooling operation, the heating operation, and a heating and defrosting operation. First, the cooling operation will be described. In the cooling operation, the compressor 6 compresses refrigerant suctioned into the compressor 6 into high-temperature and high-pressure gas refrigerant and discharges the gas refrigerant. The high-temperature and high-pressure gas refrigerant discharged from the compressor 6 branches after passing through the flow switching device 7, and respective streams of refrigerant flow into the first three-way valve 15*a* and the second three-way valve 15*b*, The refrigerant that has flowed into the first three-way valve 15*a* flows into the first heat exchanger 8*a* of the outdoor heat exchangers 8 used as condensers. In this case, in the first heat exchanger 8*a*, the refrigerant is condensed and liquified by being subjected to heat exchange with outdoor air sent by the outdoor fan 9. On the other hand, the refrigerant that has flowed into the second three-way valve 15*b* flows into the second heat exchanger 8*b* of the outdoor heat exchangers 8 used as condensers. In this case, in the second heat exchanger 8*b*, the refrigerant is condensed and liquified by being subjected to heat exchange with outdoor air sent by the outdoor fan 9.

The respective streams of condensed liquid refrigerant join together after flowing out from the first heat exchanger 8*a* and the second heat exchanger 8*b*, and the joined refrigerant flows into the expansion unit 10. The refrigerant that has flowed into the expansion unit 10 is expanded and decompressed into low-temperature and low-pressure two-phase gas-liquid refrigerant in the expansion unit 10. The two-phase gas-liquid refrigerant then flows into the indoor heat exchanger 11 used as an evaporator and is evaporated and gasified by being subjected to heat exchange with indoor air sent by the indoor fan 12 in the indoor heat exchanger 11. In this case, the indoor air is cooled, and cooling is performed indoors. The evaporated low-temperature and low-pressure gas refrigerant passes through the flow switching device 7 and is suctioned into the compressor 6.

(Operation Mode: Heating Operation)

Next, the heating operation will be described. In the heating operation, the compressor 6 compresses refrigerant suctioned into the compressor 6 into high-temperature and high-pressure gas refrigerant and discharges the gas refrigerant. The high-temperature and high-pressure gas refrigerant discharged from the compressor 6 passes through the flow switching device 7, flows into the indoor heat exchanger 11 used as a condenser, and is condensed and liquified by being subjected to heat exchange with indoor air sent by the indoor fan 12 in the indoor heat exchanger 11. In this case, the indoor air is heated, and heating is performed indoors. The condensed liquid refrigerant flows into the expansion unit 10 and is expanded and decompressed into low-temperature and low-pressure two-phase gas-liquid refrigerant in the expansion unit 10. The two-phase gas-liquid refrigerant then branches, and respective streams of refrigerant flow into the first heat exchanger 8*a* and the second heat exchanger 8*b*.

In the first heat exchanger 8*a* used as an evaporator, the refrigerant that has flowed into the first heat exchanger 8*a* is evaporated and gasified by being subjected to heat exchange with outdoor air sent by the outdoor fan 9. The evaporated low-temperature and low-pressure gas refrigerant passes through the first three-way valve 15*a*. On the other hand, in the second heat exchanger 8*b* used as an evaporator, the refrigerant that has flowed into the second heat exchanger 8*b* is evaporated and gasified by being subjected to heat exchange with outdoor air sent by the outdoor fan 9. The evaporated low-temperature and low-pressure gas refrigerant passes through the second three-way valve 15*b*. The streams of refrigerant that have passed through the first three-way valve 15*a* and the second three-way valve 15*b* join together, and the joined refrigerant is suctioned into the compressor 6.

(Operation Mode: Heating and Defrosting Operation)

Next, the heating and defrosting operation will be described. In the heating operation, frost may adhere to the outdoor heat exchangers 8. In the heating and defrosting operation, the air-conditioning apparatus 1 alternately defrosts the first heat exchanger 8*a* and the second heat exchanger 8*b* by switching between the first three-way valve 15*a* and the second three-way valve 15*b* while continuing the heating operation. First, a case in which the first heat exchanger 8*a* is defrosted will be described. In the heating and defrosting operation, the compressor 6 compresses refrigerant suctioned into the compressor 6 into high-temperature and high-pressure gas refrigerant and discharges the gas refrigerant. The high-temperature and high-pressure gas refrigerant discharged from the compressor 6 branches, and respective streams of refrigerant flow into the flow switching device 7 and the bypass pipes 13.

The refrigerant that flows into the flow switching device 7 flows into the indoor heat exchanger 11 used as a condenser and is condensed and liquified by being subjected to heat exchange with indoor air sent by the indoor fan 12 in the indoor heat exchanger 11. In this case, the indoor air is heated, and heating is performed indoors. The condensed liquid refrigerant flows into the expansion unit 10 and is expanded and decompressed into low-temperature and low-pressure two-phase gas-liquid refrigerant in the expansion unit 10. The two-phase gas-liquid refrigerant then joins refrigerant that has flowed out from the first heat exchanger 8*a*, and the joined refrigerant flows into the second heat exchanger 8*b*. In the second heat exchanger 8*b* used as an evaporator, the refrigerant that has flowed into the second heat exchanger 8*b* is evaporated and gasified by being subjected to heat exchange with outdoor air sent by the outdoor fan 9. The evaporated low-temperature and low-pressure gas refrigerant passes through the second three-way valve 15*b* and is suctioned into the compressor 6.

On the other hand, the refrigerant that flows into the bypass pipes 13 is decompressed by the bypass flow control device 14. The decompressed high-temperature refrigerant passes through the first three-way valve 15*a* and flows into the first heat exchanger 8*a*. The high-temperature refrigerant removes frost adhering to the first heat exchanger 8*a*. The refrigerant that has flowed out from the first heat exchanger 8*a* joins refrigerant that has flowed out from the expansion unit 10, and the joined refrigerant flows into the second heat exchanger 8*b*.

Next, a case in which the second heat exchanger 8*b* is defrosted will be described. In the heating and defrosting operation, the compressor 6 compresses refrigerant suctioned into the compressor 6 into high-temperature and high-pressure gas refrigerant and discharges the gas refrigerant. The high-temperature and high-pressure gas refrigerant discharged from the compressor 6 branches, and respective streams of refrigerant flow into the flow switching device 7 and the bypass pipes 13.

The refrigerant that flows into the flow switching device 7 flows into the indoor heat exchanger 11 used as a condenser and is condensed and liquified by being subjected to heat exchange with indoor air sent by the indoor fan 12 in the indoor heat exchanger 11. In this case, the indoor air is heated, and heating is performed indoors. The condensed liquid refrigerant flows into the expansion unit 10 and is expanded and decompressed into low-temperature and low-pressure two-phase gas-liquid refrigerant in the expansion unit 10. The two-phase gas-liquid refrigerant then joins refrigerant that has flowed out from the second heat exchanger 8*b*, and the joined refrigerant flows into the first heat exchanger 8*a*. In the first heat exchanger 8*a* used as an evaporator, the refrigerant that has flowed into the first heat exchanger 8*a* is evaporated and gasified by being subjected to heat exchange with outdoor air sent by the outdoor fan 9. The evaporated low-temperature and low-pressure gas refrigerant passes through the first three-way valve 15*a* and is suctioned into the compressor 6.

On the other hand, the refrigerant that flows into the bypass pipes 13 is decompressed by the bypass flow control device 14. The decompressed high-temperature refrigerant passes through the second three-way valve 15*b* and flows into the second heat exchanger 8*b*. The high-temperature refrigerant removes frost adhering to the second heat exchanger 8*b*. The refrigerant that has flowed out from the second heat exchanger 8*b* joins refrigerant that has flowed out from the expansion unit 10, and the joined refrigerant flows into the first heat exchanger 8*a*.

(Housing 20)

Figure 2:
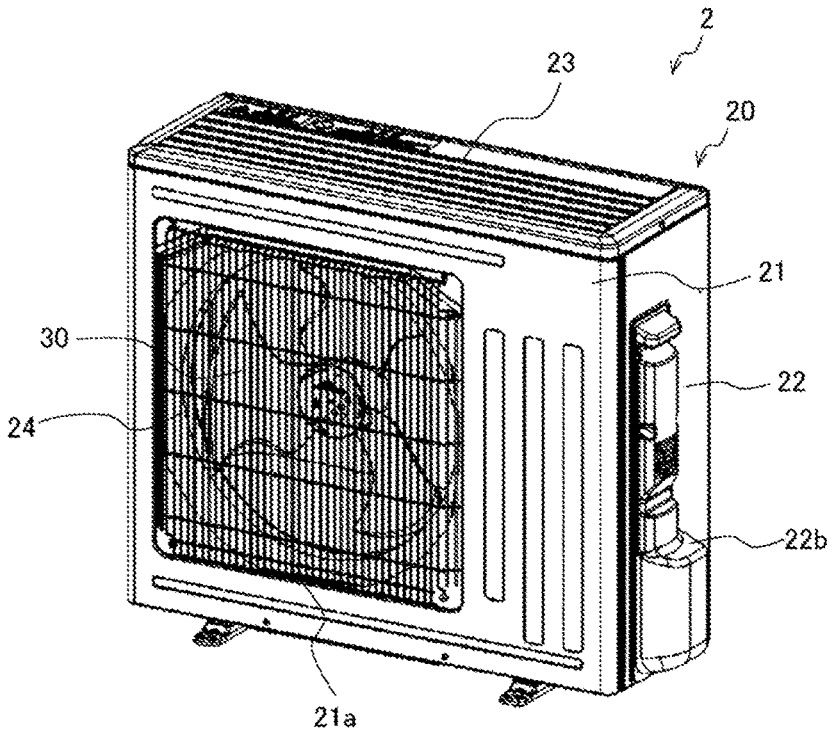
FIG. 2 is an assembled front perspective view illustrating an outdoor unit 2 according to Embodiment 1.
Figure 3:
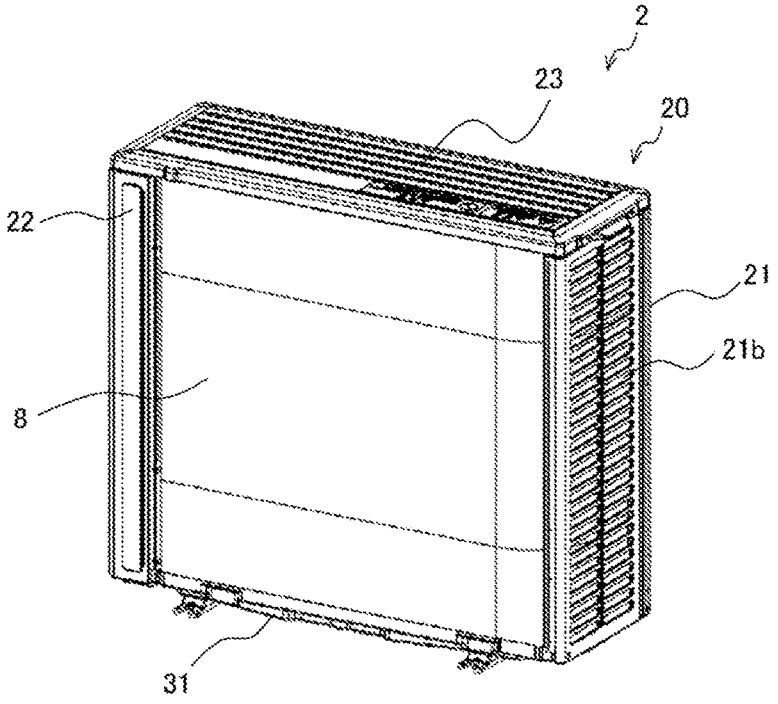
FIG. 3 is an assembled rear perspective view illustrating the outdoor unit 2 according to Embodiment 1.

FIG. 2 is an assembled front perspective view illustrating the outdoor unit 2 according to Embodiment 1. FIG. 3 is an assembled rear perspective view illustrating the outdoor unit 2 according to Embodiment 1, Next, the outdoor unit 2 will be described. As illustrated in FIG. 2, the outdoor unit 2 includes a housing 20 and internal components 30. The housing 20 includes a front panel 21, a side panel 22, a top panel 23, a fan guard 24, and a service panel 22*b*. The front panel 21 is a metal plate whose section has an L shape and that covers the front and one side of each of the internal components 30. An opening 21*a*, through which air is blown out, is provided in a part, close to the front of each of the internal components 30, of the front panel 21, Elongated holes 21*b*, each of which has a burring shape and into which air is suctioned, are provided in a part, close to the one side of each of the internal components 30, of the front panel 21. The side panel 22 is a metal plate that covers the other side of each of the internal components 30. A service opening 22*a* is provided in the side panel 22 (see FIG. 4).

The top panel 23 is a metal plate that covers the top of each of the internal components 30. The fan guard 24 is a grid-like component provided to cover the opening 21*a* provided in the front panel 21. The fan guard 24 inhibits foreign matter from entering the outdoor unit 2. The service panel 22*b* is attached to the side panel 22 and is detached when the outdoor unit 2 is inspected. When an operator inspects the outdoor unit 2, the operator detaches the service panel 22*b* and inspects the inside of the outdoor unit 2 from the service opening 22*a* provided in the side panel 22 (see FIG. 4).

(Internal Components 30)

Figure 4:
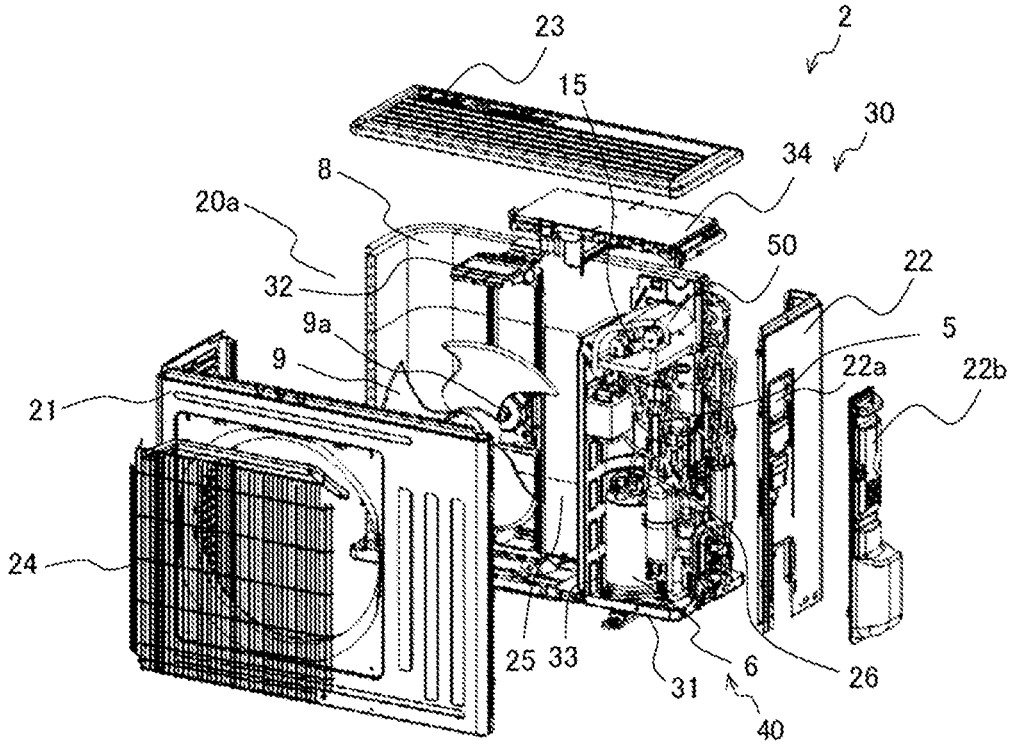
FIG. 4 is an exploded front perspective view illustrating the outdoor unit 2 according to Embodiment 1.

FIG. 4 is an exploded front perspective view illustrating the outdoor unit 2 according to Embodiment 1. Next, the internal components 30 will be described. As illustrated in FIG. 4, the internal components 30 include a bottom plate 31, the compressor 6, the outdoor heat exchangers 8, a motor support component 32, the outdoor fan 9, a partition plate 33, an electrical component box 34, refrigerant pipes 5, electronic components 40, the valves 15, and a drip inhibiting portion 50. The bottom plate 31 is a component forming the bottom of the outdoor unit 2. Here, the contours of the outdoor unit 2 are formed by the front panel 21, the side panel 22, the top panel 23, the bottom plate 31, and the outdoor heat exchangers 8.

The compressor 6 is provided on the bottom plate 31. A section of the outdoor heat exchangers 8 has, for example, an L shape. The outdoor heat exchangers 8 are provided on the bottom plate 31 and form the other side, close to the other side of each of the internal components 30, and the rear of the outdoor unit 2. The outdoor heat exchangers 8, together with the housing 20, provide a hollow portion 20*a* in the outdoor heat exchangers 8 and the housing 20. The motor support component 32 is provided in front of the part, forming the rear of the outdoor unit 2, of the outdoor heat exchangers 8. The motor support component 32 supports a fan motor 9*a*, which is configured to drive the outdoor fan 9 to rotate. The outdoor fan 9 is attached to the motor support component 32 in the hollow portion 20*a* and forms an air passage along which air is suctioned from the rear of the outdoor unit 2 and is sent to the outdoor heat exchangers 8. The partition plate 33 is a metal plate extending in a front-rear direction of the housing 20 in the hollow portion 20*a*. The partition plate 33 extends upward from the bottom plate 31. A section of the partition plate 33 has an L shape extending in the front-rear direction of the housing 20 and then extending in a width direction along the outdoor heat exchangers 8. The partition plate 33 partitions the inside of the outdoor unit 2 into a fan chamber 25 and a machine chamber 26.

Here, the outdoor heat exchangers 8 and the outdoor fan 9 are provided in the fan chamber 25. The compressor 6, the refrigerant pipes 5 connected to the compressor 6, the electronic components 40 the valves 15, and the drip inhibiting portion 50 are provided in the machine chamber 26. The electrical component box 34 is disposed above the valves 15. The electrical component box 34 houses electrical components configured to control the operation of the compressor 6 and the outdoor fan 9. The electrical component box 34 is provided at an upper end of the partition plate 33. The electrical component box 34 houses a control board (not illustrated) on which electrical components (not illustrated) having comparatively large heights, such as an electrolytic capacitor, are mounted. The electrical component box 34 includes a display unit (not illustrated) configured to light up in maintenance. The display unit is, for example, an LED lamp and is provided on the control board.

Figure 5:
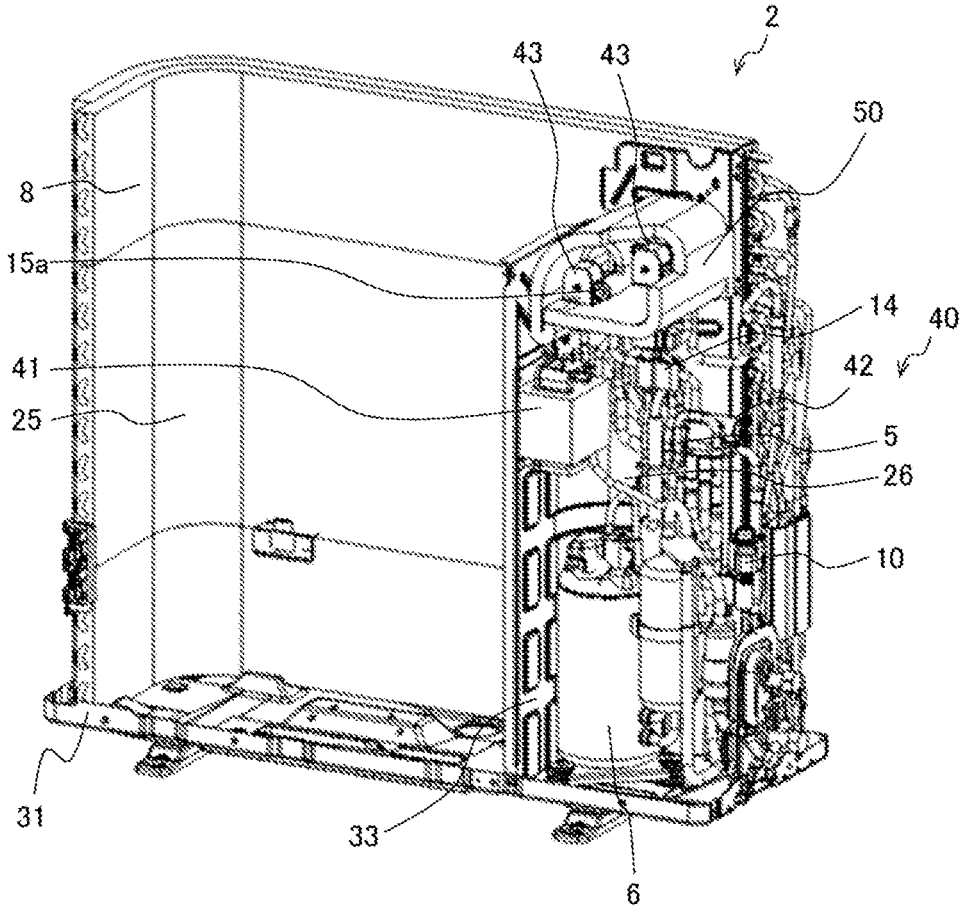
FIG. 5 is a perspective view of the outdoor unit 2 according to Embodiment 1 from which a front panel 21, a side panel 22, and a top panel 23 have been detached.
Figure 6:
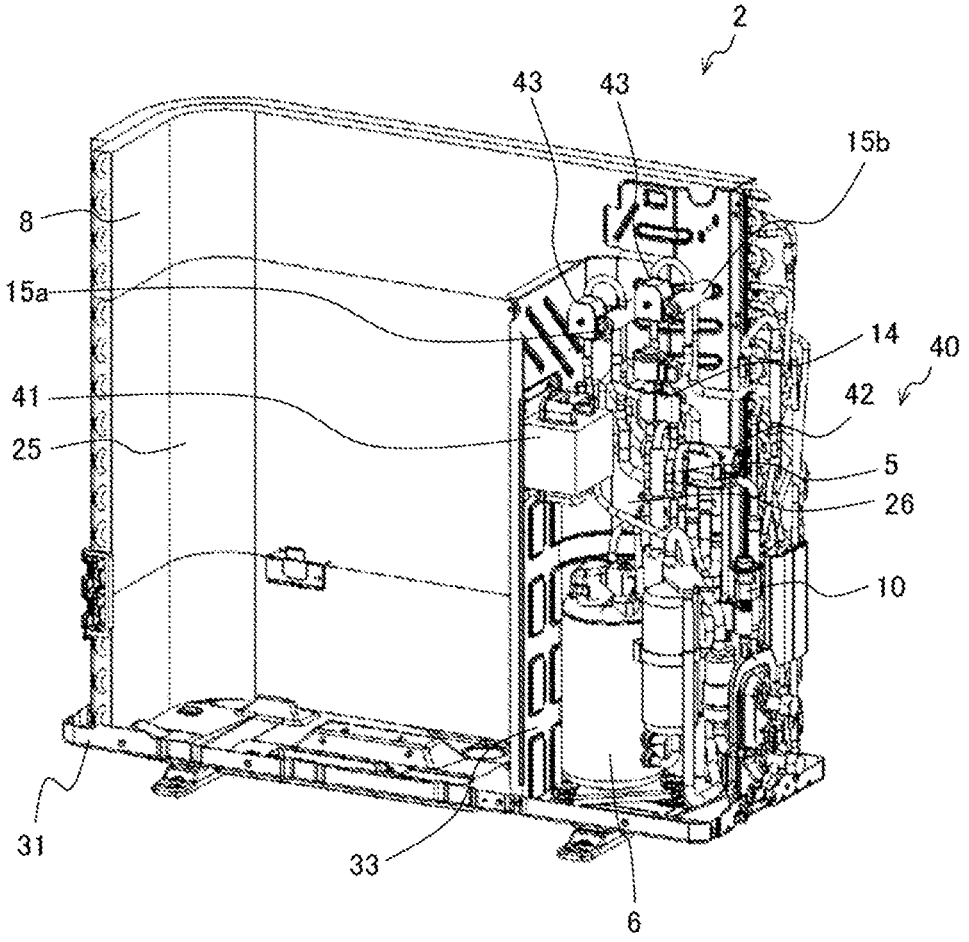
FIG. 6 is a perspective view of the outdoor unit 2 according to Embodiment 1 from which the front panel 21, the side panel 22, the top panel 23, and a drip inhibiting portion 50 have been detached.
Figure 7:
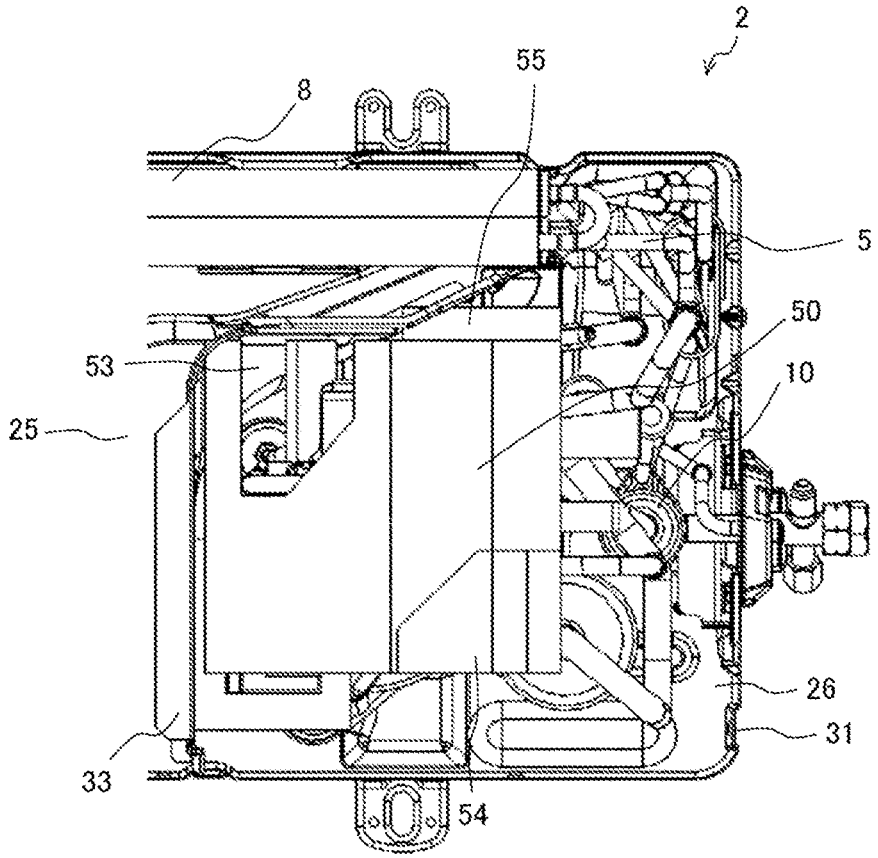
FIG. 7 is a top view illustrating refrigerant pipes 5 and the drip inhibiting portion 50 according to Embodiment 1.

FIG. 5 is a perspective view of the outdoor unit 2 according to Embodiment 1 from which the front panel 21, the side panel 22, and the top panel 23 have been detached. FIG. 6 is a perspective view of the outdoor unit 2 according to Embodiment 1 from which the front panel 21, the side panel 22, the top panel 23, and the drip inhibiting portion 50 have been detached. FIG. 7 is a top view illustrating the refrigerant pipes 5 and the drip inhibiting portion 50 according to Embodiment 1. As illustrated in FIGS. 5 to 7, as described above, the refrigerant pipes 5 connect the compressor 6, the flow switching device 7, the outdoor heat exchangers 8, the expansion unit 10, and the indoor heat exchanger 11 and stretch from a lower part to an upper part of the machine chamber 26 of the outdoor unit 2. The electronic components 40 in Embodiment 1 are, for example, a reactor 41, the expansion unit 10, a four-way valve coil 42, which is configured to switch the flow switching device 7, and the bypass flow control device 14.

Figure 8:
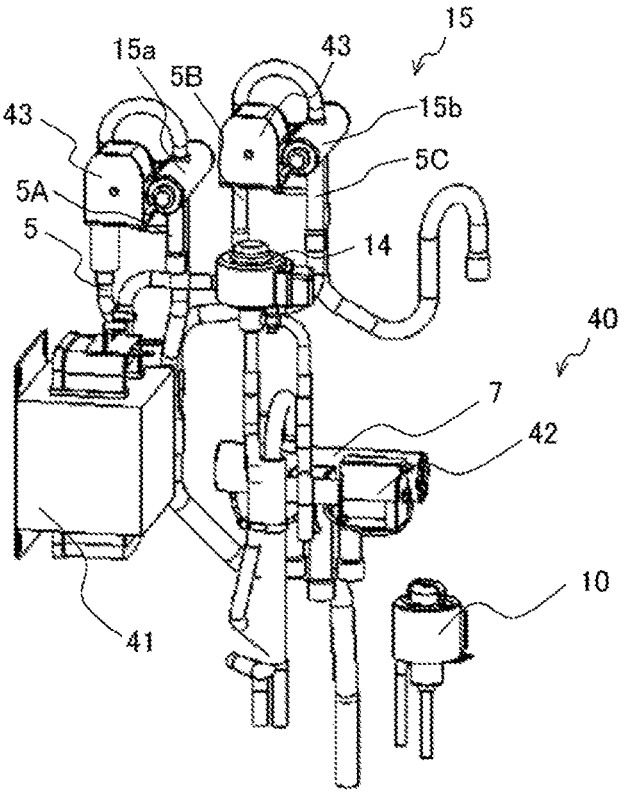
FIG. 8 is a perspective view illustrating the refrigerant pipes 5 according to Embodiment 1.
Figure 9:
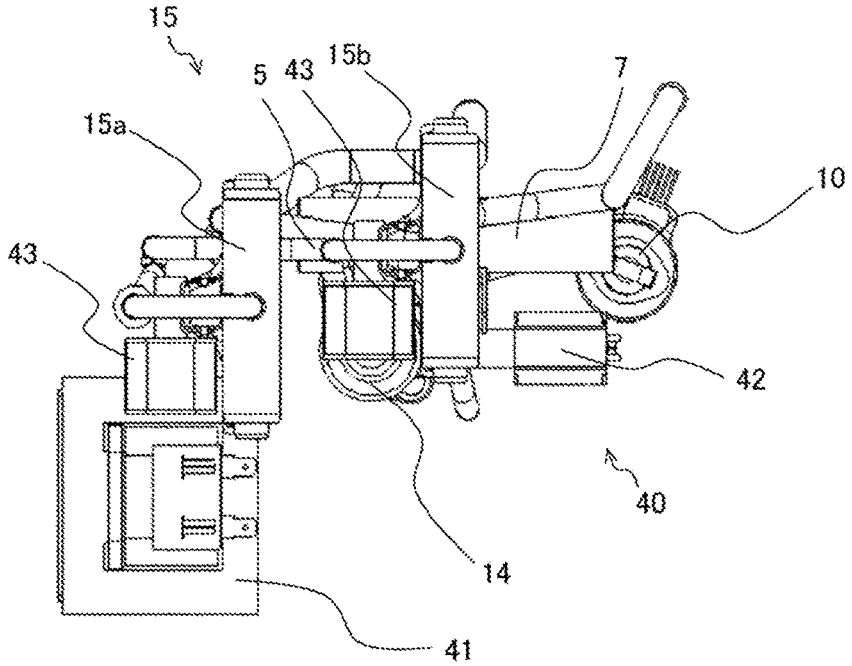
FIG. 9 is a top view illustrating the refrigerant pipes 5 according to Embodiment 1.

FIG. 8 is a perspective view illustrating the refrigerant pipes 5 according to Embodiment 1. FIG. 9 is a top view illustrating the refrigerant pipes 5 according to Embodiment 1. As described above, the valves 15 switch between the direction in which refrigerant flows toward the first heat exchanger 8*a* and the direction in which refrigerant flows toward the second heat exchanger 8*b*, and, for example, the valves 15 include the first three-way valve 15*a* and the second three-way valve 15*b*. As illustrated in FIGS. 8 and 9, the first three-way valve 15*a* and the second three-way valve 15*b* are connected to the refrigerant pipes 5 in the machine chamber 26 and are disposed above the electronic components 40. The first three-way valve 15*a* and the second three-way valve 15*b* are provided with respective three-way valve coils 43, which are configured to switch between the first three-way valve 15*a* and the second three-way valve 15*b*.

As illustrated in FIG. 8, the expansion unit 10, the flow switching device 7, the four-way valve coil 42, the reactor 41, the bypass flow control device 14, the first three-way valve 15*a*, the second three-way valve 15*b*, and the three-way valve coils 43 are disposed in this order in a direction from a lower part to an upper part of the machine chamber 26. As illustrated in FIG. 9, the reactor 41, the bypass flow control device 14, and other components are disposed below the position where the refrigerant pipes 5 are disposed. The positional relationships of the components in the width direction, the front-rear direction, and the front-rear direction are examples and may be different positional relationships. Here, the electronic components 40 are disposed at positions that are not directly below the refrigerant pipes 5 connected to the valves 15 and that are not directly below the refrigerant pipes 5 connected to the valves 15.

Figure 10:
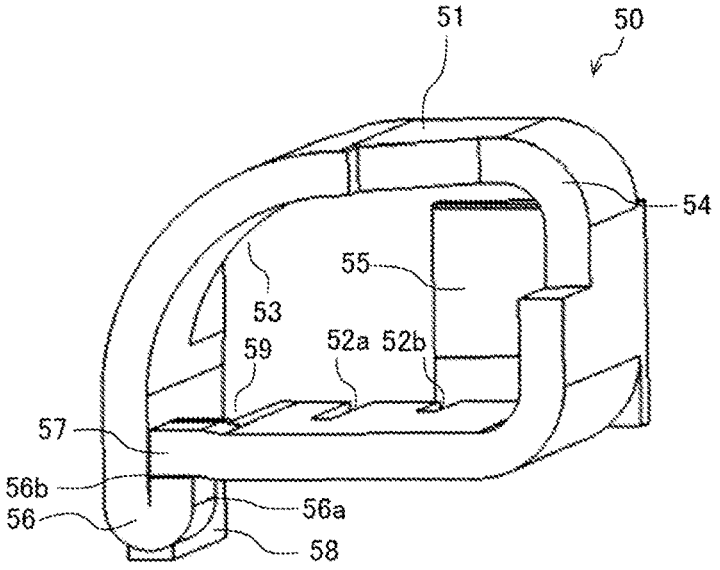
FIG. 10 is a perspective view illustrating the drip inhibiting portion 50 according to Embodiment 1.
Figure 11:
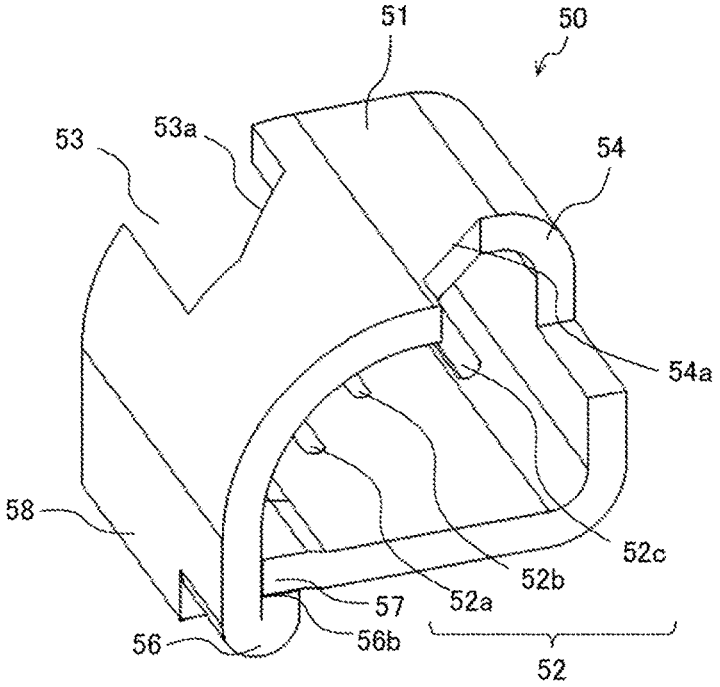
FIG. 11 is a perspective view illustrating the drip inhibiting portion 50 according to Embodiment 1.
Figure 12:
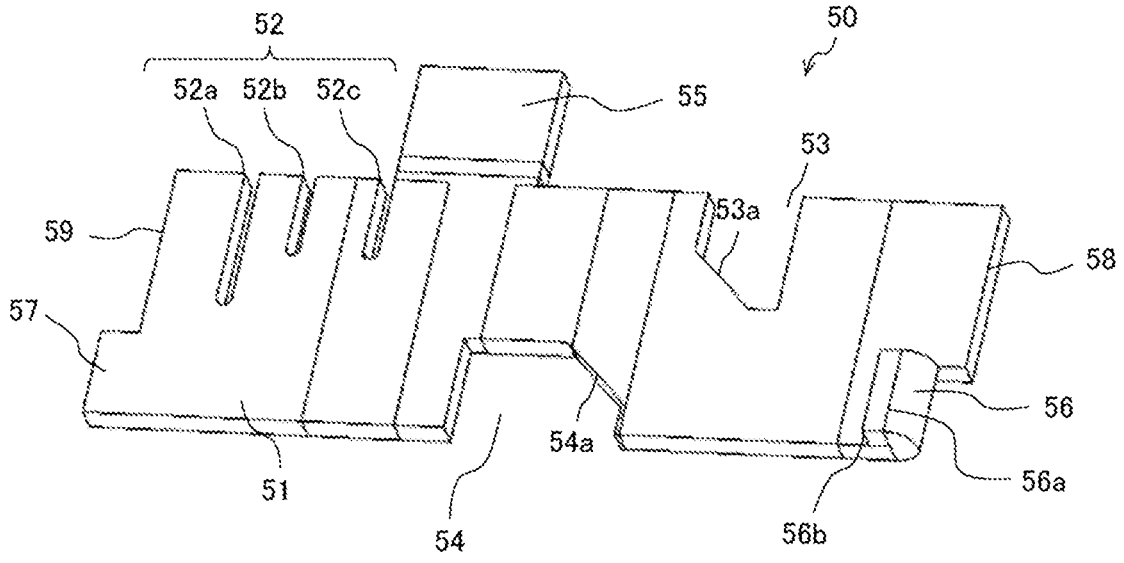
FIG. 12 is a developed perspective view illustrating the drip inhibiting portion 50 according to Embodiment 1.

FIG. 10 is a perspective view illustrating the drip inhibiting portion 50 according to Embodiment 1. FIG. 11 is a perspective view illustrating the drip inhibiting portion 50 according to Embodiment 1. FIG. 12 is a developed perspective view illustrating the drip inhibiting portion 50 according to Embodiment 1. The drip inhibiting portion 50 covers each lower part of the valves 15 including the first three-way valve 15*a* and the second three-way valve 15*b*. The drip inhibiting portion 50 inhibits water dripping from the refrigerant pipes 5 from dripping onto the electronic components 40. Here, for example, the drip inhibiting portion 50 absorbs water dripping from the valves 15. In addition, the drip inhibiting portion 50 is formed to repel and hold water droplets on the drip inhibiting portion 50. Furthermore, the drip inhibiting portion 50 is formed to cause water dripping from the refrigerant pipes 5 to drip onto positions in a lower space where the electronic components 40 do not exist. Here, the drip inhibiting portion 50 is made of, for example, felt. The drip inhibiting portion 50 may be made of a material mainly containing a fiber usable as a sound absorbing material for the compressor 6. As illustrated in FIGS. 10 to 12, the drip inhibiting portion 50 includes a band portion 51, a protecting portion 55, a folded-back portion 56, and an engagement portion 57. The drip inhibiting portion 50 may have a cylindrical shape.

The band portion 51 is a long component extending in the width direction. The band portion 51 surrounds the valves 15 such that the band portion 51 covers a lower part, side parts, and an upper part of each valve 15. The band portion 51 inhibits a side end portion of each valve 15 from coming into contact with the partition plate 33 (see FIG. 5). The band portion 51 has slits 52, into which the refrigerant pipes 5 connected to the valves 15 are inserted. The slits 52 enable the band portion 51 to surround the valves 15 without being obstructed by the refrigerant pipes 5 connected to the valves 15. For example, the slits 52 include a first slit 52*a*, a second slit 52*b*, and a third slit 52*c*.

The first slit 52*a* is obtained by cutting out a part of the band portion 51 at a position close to the other end of the band portion 51 in the long-side direction such that the first slit 52*a* extends in a direction from the rear to the front of the outdoor unit 2. A refrigerant pipe 5A of the refrigerant pipes 5 illustrated in FIG. 8 is inserted into the first slit 52*a*. The second slit 52*b* is adjacent to the first slit 52*a*. The second slit 52*b* is obtained by cutting out a part of the band portion 51 such that the second slit 52*b* extends in the direction from the rear to the front of the outdoor unit 2. The second slit 52*b* is shorter than the first slit 52*a*. A refrigerant pipe 5B of the refrigerant pipes 5 illustrated in FIG. 8 is inserted into the second slit 52*b*. The third slit 52*c* is adjacent to the second slit 52*b*. The third slit 52*c* is obtained by cutting out a part of the band portion 51 such that the third slit 52*c* extends in the direction from the rear to the front of the outdoor unit 2. The third slit 52*c* has a length equal to that of the second slit 52*b*. A refrigerant pipe 5C of the refrigerant pipes 5 illustrated in FIG. 8 is inserted into the third slit 52*c*.

The band portion 51 has an electrical-component escape space 53. The electrical-component escape space 53 is obtained by cutting out a part of the band portion 51, at a position closer than the third slit 52*c* to one side in a state in which the drip inhibiting portion 50 is developed, in the direction from the rear to the front of the outdoor unit 2 such that the electrical-component escape space 53 has a trapezoidal shape and has a first inclined surface 53*a*. The electrical-component escape space 53 is positioned close to the top panel 23 in a state in which the valves 15 are surrounded by the band portion 51. Electrical components included in the electrical component box 34 are inserted into the electrical-component escape space 53. Specifically, for example, an electrolytic capacitor (not illustrated) that is mounted on the control board housed in the electrical component box 34 and that projects from the control board is inserted into the electrical-component escape space 53.

The band portion 51 has a display-unit escape space 54. The display-unit escape space 54 is obtained by cutting out a part of the band portion 51, at a position between the third slit 52*c* and the electrical-component escape space 53 in the state in which the drip inhibiting portion 50 is developed, in a direction from the front to the rear of the outdoor unit 2 such that the display-unit escape space 54 has a trapezoidal shape and has a second inclined surface 54*a* In this manner, the display-unit escape space 54 has a shape similar to that of the electrical-component escape space 53. The first inclined surface 53*a* and the second inclined surface 54*a* are parallel to each other. The first inclined surface 53*a* and the second inclined surface 54*a* do not have to be parallel to each other. This enables the distance between the electrical-component escape space 53 and the display-unit escape space 54 to be left even when the electrical-component escape space 53 and the display-unit escape space 54 are cut out from the band portion 51.

The display-unit escape space 54 is positioned close to the top panel 23 in the state in which the valves 15 are surrounded by the band portion 51. The display-unit escape space 54 allows the display unit included in the electrical component box 34 to be visible from the outside of the housing 20. Specifically, when an operator inspects the outdoor unit 2, the operator detaches the service panel 22*b*. Then, the display unit included in the electrical component box 34 is visible to the operator from the service opening 22*a* of the side panel 22. The display-unit escape space 54 is provided on a sight line along which the display unit is visible to the operator. The display-unit escape space 54 does not prevent the display unit from being visible to the operator and enables the display unit to have visibility.

The protecting portion 55 extends upward from the band portion 51 in a state in which the valves 15 are surrounded by the band portion 51. The protecting portion 55 inhibits an end portion of each valve 15 in the front-rear direction from coming into contact with the partition plate 33. The protecting portion 55 is provided between the third slit 52*c* and the electrical-component escape space 53 in the state in which the drip inhibiting portion 50 is developed. The protecting portion 55 has a cuboid shape. The protecting portion 55 is inserted between the partition plate 33 and the valves 15 by being bent upward from the rear side by 90 degrees after the valves 15 are surrounded by the band portion 51 (see FIG. 7). This inhibits the partition plate 33 and the valves from coming into contact with each other even when the outdoor unit 2 is shaken during transportation or even when drop impact occurs in the outdoor unit 2 because of incorrect handling of the outdoor unit 2.

The folded-back portion 56 is folded back at one end portion of the band portion 51. To form the folded-back portion 56, a part formed by making a cut in a part of the one end portion of the band portion 51 is folded back by 180 degrees. The folded-back portion 56 is sewn at a stitch portion 56*a* and is thus held in the folded back state. The engagement portion 57 is a cuboid component projecting from the other end portion of the band portion 51. The engagement portion 57 is a stopper engaged with the folded-back portion 56 at the other end portion of the band portion 51 surrounding the valves 15.

Specifically, a step portion 56*b*, which is formed when the folded-back portion 56 is folded back by 180 degrees, is caught by the engagement portion 57. This keeps a state in which the valves 15 are surrounded by the drip inhibiting portion 50. When the valves 15 are surrounded by the band portion 51, a space insertion portion 58, which is the part, other than the folded-back portion 56, of the one end portion of the band portion 51, enters the space between the partition plate 33 and a space defining portion 59, which is the part, other than the engagement portion 57, of the other end portion of the band portion 51.

Next, the operation in which the drip inhibiting portion 50 surrounds the valves 15 will be described. In a state in which the other end side of the band portion 51 is disposed to face the partition plate 33, the refrigerant pipes 5A, 5B, and 5C are respectively inserted into the first slit 52*a*, the second slit 52*b*, and the third slit 52*c* of the band portion 51. Then, the protecting portion 55 is bent upward from the rear side by 90 degrees and is inserted between the partition plate 33 and the valves 15.

In addition, the one end side of the band portion 51 is bent by 90 degrees in a direction from the side panel 22 toward the top panel 23 and is further bent by 90 degrees in a direction from the top panel 23 toward the partition plate 33 while covering the side parts of each valve 15. Then, the folded-back portion 56 is engaged with the engagement portion 57 while the band portion 51 covers the upper part of each valve 15. As a result, the drip inhibiting portion 50 is formed into a cylindrical shape. The folded-back portion 56 and the space insertion portion 58 are inserted between the partition plate 33 and the valves 15 or between the partition plate 33 and the refrigerant pipes 5. As a result, the drip inhibiting portion 50 is fixed in the machine chamber 26.

According to Embodiment 1, the drip inhibiting portion 50 covers the lower part of each valve 15 and the refrigerant pipes 5 disposed above the electronic components 40. Thus, the drip inhibiting portion 50 is capable of inhibiting, even when dew is formed on the refrigerant pipes 5 connected to the valves 15, the dew from dripping onto the electronic components 40 at lower positions. For example, by absorbing water dripping from the valves 15, the drip inhibiting portion 50 inhibits the water from dripping onto the electronic components 40 at lower positions. In addition, the drip inhibiting portion 50 is formed to repel and hold water droplets on the drip inhibiting portion 50 and is formed to cause water dripping from the refrigerant pipes 5 to drip onto positions in a lower space where the electronic components 40 do not exist. In this manner, the drip inhibiting portion 50 inhibits water from dripping onto the electronic components 40 at lower positions. As described above, the drip inhibiting portion 50 inhibits dew from dripping onto each energized part of the electronic components 40. Thus, it is possible to inhibit occurrence of a short circuit.

In addition, the partition plate 33 extends in the front-rear direction of the housing 20. The drip inhibiting portion 50 includes the band portion 51, which has a band shape and surrounds the valves 15 such that the band portion 51 covers the lower part, the side parts, and the upper part of each valve 15. This inhibits the side end portion of each valve 15 from coming into contact with the partition plate 33. Furthermore, the partition plate 33 extends in the width direction of the housing 20. The drip inhibiting portion 50 further includes the protecting portion 55, which extends upward from the band portion 51 and inhibits the end portion of each valve 15 in the front-rear direction from coming into contact with the partition plate 33. This inhibits the partition plate 33 and the valves 15 from coming into contact with each other even when the outdoor unit 2 is shaken during transportation or even when drop impact occurs in the outdoor unit 2 because of incorrect handling of the outdoor unit 2.

The band portion 51 has the slits 52, into which the refrigerant pipes 5 connected to the valves 15 are inserted. Thus, the band portion 51 is held by the refrigerant pipes 5. Accordingly, there is no need to provide an additional support component. The drip inhibiting portion 50 further includes the folded-back portion 56, which is folded back at the one end portion of the band portion 51, and the engagement portion 57, which is engaged with the folded-back portion 56 at the other end portion of the band portion 51 surrounding the valves 15. This keeps a state in which the drip inhibiting portion 50 is formed into a cylindrical shape.

REFERENCE SIGNS LIST

1: air-conditioning apparatus, 2: outdoor unit, 3: indoor unit, 4: refrigerant circuit, 5, 5A, 5B, 5C: refrigerant pipe, 6: compressor, 7: flow switching device, 8: outdoor heat exchanger, 8*a*: first heat exchanger, 8*b*: second heat exchanger, 9: outdoor fan, 9*a*: fan motor, 10: expansion unit, 11: indoor heat exchanger, 12: indoor fan, 13: bypass pipe, 14: bypass flow control device, 15: valve, 15*a*: first three-way valve, 15*b*: second three-way valve, 20: housing, 20*a*: hollow portion, 21: front panel, 21*a*: opening, 21*b*: elongated hole, 22: side panel, 22*a*: service opening, 22*b*: service panel, 23: top panel, 24: fan guard, 25: fan chamber, 26: machine chamber, 30: internal component, 31: bottom plate, 32: motor support component, 33: partition plate, 34: electrical component box, 40: electronic component, 41: reactor, 42: four-way valve coil, 43: three-way valve coil, 50: drip inhibiting portion, 51: band portion, 52: slit, 52*a*: first slit, 52*b*: second slit, 52*c*: third slit, 53: electrical-component escape space, 53*a*: first inclined surface, 54: display-unit escape space, 54*a*: second inclined surface, 55: protecting portion, 56: folded-back portion, 56*a*: stitch portion, 56*b*: step portion, 57: engagement portion, 58: space insertion portion, 59: space defining portion

The invention claimed is:

1. An outdoor unit for an air-conditioning apparatus, the outdoor unit comprising:

a housing;

a compressor provided in the housing, the compressor being configured to compress refrigerant;

an outdoor heat exchanger provided in the housing, the outdoor heat exchanger allowing refrigerant and air to exchange heat with each other;

a partition plate provided in the housing, the partition plate partitioning an inside of the housing into a fan chamber and a machine chamber in which the compressor is provided;

an electronic component provided in the machine chamber;

a refrigerant pipe provided in the machine chamber, the refrigerant pipe connecting the compressor and the outdoor heat exchanger and being disposed above the electronic component;

a valve connected to the refrigerant pipe in the machine chamber, the valve being disposed above the electronic component; and a drip inhibiting portion that covers the refrigerant pipe and surrounds the valve such that the drip inhibiting portion covers a lower part, side parts, and an upper part of the valve, the drip inhibiting portion inhibiting water dripping from the refrigerant pipe from dripping onto the electronic component, wherein the partition plate extends in a front-rear direction of the housing, and the drip inhibiting portion includes a band portion having a band shape, the band portion inhibiting a side end portion of the valve from coming into contact with the partition plate.

2. The outdoor unit for an air-conditioning apparatus of claim 1, wherein the partition plate extends in a width direction of the housing, and the drip inhibiting portion further includes a protecting portion extending upward from the band portion, the protecting portion inhibiting an end portion of the valve in the front-rear direction from coming into contact with the partition plate.

3. The outdoor unit for an air-conditioning apparatus of claim 1, wherein the band portion has a slit into which the refrigerant pipe connected to the valve is inserted.

4. The outdoor unit for an air-conditioning apparatus of claim 1, the outdoor unit further comprising an electrical component box disposed above the valve, the electrical component box including an electrical component configured to control operation of the compressor, wherein the band portion has an electrical-component escape space obtained by cutting out a part of the band portion such that the electrical component is inserted into the electrical-component escape space.

5. The outdoor unit for an air-conditioning apparatus of claim 1, the outdoor unit further comprising an electrical component box disposed above the valve, the electrical component box including an electrical component configured to control operation of the compressor, wherein the electrical component box includes a display unit configured to light up in maintenance, and the band portion has a display-unit escape space obtained by cutting out a part of the band portion such that the display-unit escape space allows the display unit to be visible from an outside of the housing.

6. The outdoor unit for an air-conditioning apparatus of claim 1, wherein the drip inhibiting portion further includes a folded-back portion folded back at one end portion of the band portion, and an engagement portion engaged with the folded-back portion at an other end portion of the band portion surrounding the valve.

7. The outdoor unit for an air-conditioning apparatus of claim 1, wherein the drip inhibiting portion is made of a material mainly containing a fiber usable as a sound absorbing material for the compressor.

8. The outdoor unit for an air-conditioning apparatus of claim 1, wherein the drip inhibiting portion is made of felt.

9. An air-conditioning apparatus comprising:

the outdoor unit for an air-conditioning apparatus of claim 1, the outdoor unit further including a flow switching device configured to switch between directions in which refrigerant flows, and an expansion unit configured to expand refrigerant; and an indoor unit including an indoor heat exchanger that allows refrigerant and air to exchange heat with each other, wherein the outdoor heat exchanger includes a first heat exchanger and a second heat exchanger, a passage of the first heat exchanger and a passage of the second heat exchanger being parallel to each other, and a refrigerant circuit is formed by connecting, by the refrigerant pipe, the compressor, the flow switching device, the indoor heat exchanger, the expansion unit, the outdoor heat exchanger, the valve configured to switch between a direction in which refrigerant flows toward the first heat exchanger and a direction in which refrigerant flows toward the second heat exchanger, and a bypass pipe connecting the valve and a part between the compressor and the flow switching device.

* * * * *